US005203516A

United States Patent [19]

Donaldson

[11] Patent Number: 5,203,516

[45] Date of Patent: Apr. 20, 1993

[54] HEAVY DUTY SPOOL

[75] Inventor: Charles D. Donaldson, Loveland, Ohio

[73] Assignee: Dyment Limited, Canada

[21] Appl. No.: 730,436

[22] Filed: Jul. 16, 1991

[51] Int. Cl.[5] ..... B65H 75/14; B65H 75/18

[52] U.S. Cl. ..... 242/71.8; 242/118.6; 242/118.8

[58] Field of Search ..... 242/71.8, 77, 77.3, 242/118.8, 118.7, 118.4, 118.6

[56] References Cited

U.S. PATENT DOCUMENTS

| | | | |
|---|---|---|---|
| D. 122,897 | 10/1940 | Lion . | |
| D. 180,633 | 7/1957 | Wilke | D41/1 |
| D. 227,975 | 7/1973 | Diamond | D8/8 |
| D. 290,340 | 6/1987 | McCaffrey | D8/358 |
| D. 300,405 | 3/1989 | Kuntze | D8/358 |
| 335,692 | 7/1885 | Fries . | |
| 671,446 | 4/1901 | Lorscheider . | |
| 1,565,655 | 12/1925 | Lefebvre . | |
| 1,634,436 | 7/1927 | Polson . | |
| 1,655,065 | 1/1928 | Baron . | |
| 2,001,569 | 5/1935 | Kiefer | 242/118 |
| 2,144,723 | 1/1939 | Howsam | 242/123 |
| 2,229,413 | 1/1941 | Joost | 175/356 |
| 2,232,461 | 2/1941 | Kuckhoff | 242/71.8 |
| 2,341,491 | 2/1944 | Tucker | 242/70 |
| 2,354,375 | 7/1944 | Howsam | 242/118 |
| 2,546,253 | 3/1951 | Beauregard | 242/72 |
| 2,741,442 | 4/1956 | Aupperle | 242/118 |
| 2,772,056 | 11/1956 | Harpfer | 242/96 |
| 2,799,458 | 7/1957 | Nye | 242/118.8 |
| 2,828,090 | 3/1958 | Steinbeck | 242/118.7 |
| 2,953,316 | 9/1960 | Henry | 242/118.7 |
| 2,969,931 | 1/1961 | Goldman | 242/118.4 |
| 2,992,791 | 7/1961 | Johnson | 242/118.8 |
| 3,025,021 | 3/1962 | McCluer | 242/118.4 |
| 3,059,763 | 10/1962 | Eifrid | 206/59 |
| 3,101,846 | 8/1963 | Eifrid | 206/59 |
| 3,104,077 | 9/1963 | Struble | 242/118.8 |
| 3,266,749 | 8/1966 | Christian | 242/118.7 |
| 3,537,667 | 11/1970 | Dorman | 242/118.8 |
| 3,626,495 | 12/1971 | Bastian | 242/85.1 |
| 3,866,327 | 2/1975 | Pacini | 33/125 |
| 3,876,073 | 4/1975 | Herbetko | 242/118.8 X |
| 3,881,668 | 5/1975 | Poteat | 242/118.6 |
| 3,927,687 | 12/1975 | Thierman | 132/92 |
| 3,958,775 | 5/1976 | Liga | 242/118.8 |
| 3,971,526 | 7/1976 | Underwood | 242/118.6 |
| 4,021,004 | 5/1977 | Poteat | 242/118.6 |
| 4,030,681 | 6/1977 | Schott | 242/81 |

(List continue on next page.)

*Primary Examiner*—Stanley N. Gilreath
*Attorney, Agent, or Firm*—Ruden, Barnett, McClosky, Smith, Schuster & Russell

[57] ABSTRACT

Heavy duty spools having the capacity to hold at least about 375 to 675 pounds of product, such as between about 2,800 and about 3,000 unfilled plastic or paper bags which are sized to hold disposable diapers, are disclosed. The heavy duty spools of the instant invention are preferably fabricated from paperboard materials and include two flange plates connected by a hollow outer core. The hollow outer core is formed from a plurality of corrugated interlocks, each having locking arms on the ends thereof. The flange plates have central openings and a plurality of anchoring slots spaced around the central openings. The anchoring slots extend radially from and intersect the central openings and cooperate with the locking arms of the hollow outer core to anchor the hollow outer core snugly against the flange plates. Interlocks, when assembled into the hollow outer core, form unique ribs which lend support to the hollow outer core. Inserted inside the hollow outer core and through the central openings is a hollow inner core preferably formed of solid paper wrap. The inserted hollow inner core abuts the ribs inside the hollow outer core and lends further support to the hollow outer core through the ribs. The flange plates may be provided with viewing holes so that the plastic or paper bags wound thereon can be viewed and monitored during use of the assembled spool. The flange plates may further be provided with flat regions to prevent the spools from rolling during shipment.

15 Claims, 4 Drawing Sheets

U.S. PATENT DOCUMENTS

| | | | |
|---|---|---|---|
| 4,060,210 | 11/1977 | Norris | 242/71.1 |
| 4,066,224 | 1/1978 | Hargreaves | 242/115 |
| 4,083,450 | 4/1978 | Lamar | 206/416 |
| 4,101,095 | 7/1978 | Carter | 242/115 |
| 4,119,279 | 10/1978 | Hosbein | 242/54 |
| 4,142,690 | 3/1979 | Karle | 242/46.4 |
| 4,192,600 | 3/1980 | Karikawa | 354/212 |
| 4,193,560 | 3/1980 | Diegel | 242/71.9 |
| 4,211,375 | 7/1980 | Weiss | 242/81 |
| 4,244,538 | 1/1981 | Theros | 242/118.8 |
| 4,269,371 | 5/1981 | Kovaleski | 242/118.6 |
| 4,353,510 | 10/1982 | Damke | 242/118.32 |
| 4,387,863 | 6/1983 | Edmonston | 242/118.4 |
| 4,406,422 | 9/1983 | Philips | 242/118.4 |
| 4,412,661 | 11/1983 | Wise | 242/77.4 |
| 4,497,457 | 2/1985 | Harvey | 242/96 |
| 4,580,743 | 4/1986 | Bauer | 242/118.6 |
| 4,715,556 | 12/1987 | Tack | 242/118.6 |
| 4,739,945 | 4/1988 | Yokoe | 242/118.41 |
| 4,769,652 | 9/1988 | Cleary | 346/136 |
| 4,771,962 | 9/1988 | Gavin | 242/56.9 |
| 4,831,771 | 5/1989 | Hoffken | 43/54.1 |
| 4,852,821 | 8/1969 | Harris | 242/71.8 |
| 4,991,788 | 2/1991 | Pattison | 242/85.1 |

HEAVY DUTY SPOOL

FIELD OF THE INVENTION

The present invention relates to a heavy duty spool fabricated from, for example, paperboard upon which various products, such as at least about 2,800 unfilled plastic or paper bags which are sized to hold disposable diapers, hose, cables or other linear pieces of extruded plastic, may suitably be wound.

BACKGROUND

Heavy duty spools having round flange plates connected by a central cylindrical core piece, upon which unfilled plastic bags sized to hold disposable diapers are wound, have been used for many years. Such spools normally have been made from wood and steel and generally weigh about 25 pounds each. More particularly, such wood spools are formed with plywood flange plates, hollow cores and threaded steel rods that hold the plywood flange plates flush against the cores.

Even though such wood spools have been used in the past, they are not without drawbacks. First, because the spools are fabricated from wood and steel, the spools must be lined with a suitable material, such as polyethylene, prior to winding the unfilled plastic bags thereon to avoid splintering and/or tearing the plastic bags. Such a plastic liner obviously adds to the cost of using the wood spools for storing and shipping the unfilled plastic bags.

Second, the wood spools are difficult to dispose of following their use. This disposal problems is underscored by the fact that the wood spools cannot be burned since they include steel rods. Alternatively, the wood spools are not reused due to the cost associated with shipping the empty wood spools back to the plastic bag manufacturing facilities. This excessive shipping costs can be attributed to the fact that each empty wood spool generally weighs approximately 25 pounds and that the unfilled plastic bags are typically manufactured and wound upon the wood spools at geographical locations which in some cases are located far from where the disposal diapers are manufactured and packaged. Consequently, the shipping costs associated with the used empty wood spools generally exceeds the cost to manufacture new wood spools at locations relatively near the facilities for manufacturing the plastic bags.

Third, because the wood spools have been fabricated with round flange plates, costly containers and foam saddles are required to package the loaded wood spools for shipment to prevent the wood spools from rolling. Moreover, costly viewing holes must be drilled through the plywood flange plates adjacent the cores prior to winding the unfilled plastic bags onto the wood spools so that the unfilled plastic bags can be effectively visualized and monitored as they are wound onto and unwound from the wood spools.

Consequently, there is a need in the spool industry and in particular disposable diaper industry for an economical, lightweight, disposable and durable heavy duty spool which has the ability to carry industrial quantities of product, such as unfilled plastic or paper bags which are sized to hold disposable diapers, which do not require costly liners to avoid splintering and/or tearing the plastic or paper bags wound thereon, which can be manufactured and shipped inexpensively, and which can be either economically reused or economically disposed of in a manner consistent with environmental requirements.

SUMMARY OF THE INVENTION

In brief, the present invention alleviates and overcomes certain of the above-mentioned problems and shortcomings of the present state of the spool art through the discovery of a novel heavy duty spool preferably fabricated from paperboard material and which meets the above demand for an economical, lightweight and durable spool that can be either reused or recycled or that can biodegrade following use.

Generally speaking, the novel heavy duty spools of the instant invention include two flange plates connected or bridged by a hollow outer core. The hollow outer core is formed preferably of a plurality of interlocks cut from corrugated blanks, each interlock being composed of two end panels hingedly connected along fold lines to a center panel. At the end of each end panel is a locking arm hingedly connected thereto along a first fold line. Each locking arm is also provided with a second fold line wherein an integral flap lies between the first and second fold lines, and a hold tab is hingedly connected to the integral flap along the second fold line. Each flange plate preferably includes an inner layer fabricated from at least one piece of double-walled or single-walled corrugated material laminated together which is sandwiched between two outer layers of solid fiberboard. Each flange plate further includes a central opening and a plurality of anchoring slots spaced around the central opening cut into it. The anchoring slots uniquely intersect and extend radially from the central opening to cooperate with the locking arms hingedly connected to the end panels of the hollow outer core to anchor or lock the hollow outer core snugly against the flange plates.

Uniquely, when the hollow outer core is formed from the interlocks and connected to the flange plates to form a spool of the instant invention, the end panels of the interlocks and the holding tabs of the locking arms form internal ribs which extend radially inwardly of the hollow outer core to lend support to the hollow outer core. Moreover, when a hollow inner core is received within the hollow outer core and central openings in the flange plates, the edges of the ribs formed by the end panels and holding tabs abut the exterior surface of the hollow inner core so that the hollow inner core uniquely provides further support to the hollow outer core through the ribs..

A novel heavy duty paperboard spool of the instant invention typically weighs on the order of about 8.75 pounds and has the ability to carry or hold various products, such as hose, cables, wires, ropes, linear pieces of extruded plastic or, for example, about 375 pounds or more or about 2,800 or more unfilled plastic or paper bags which are sized to hold disposable diapers. Moreover, because the novel heavy duty spools of the present invention are fabricated from paperboard materials, there is no need to pre-line them with polyethylene materials to avoid splintering and/or tearing the plastic or paper bags, as required with the wood spools available hitherto. Still further, because the flange plates are formulated from paperboard materials, viewing holes can be inexpensively cut into them so that the plastic bags can be visually and continuously monitored during operation of the loaded assembled spools. Moreover, flat regions can be economically cut on the ends of the cylindrical flange plates to prevent the spools from rolling during shipment thereby eliminating the need for costly shipping foam saddles presently required with the wood spools utilized heretofore. Still further, because the heavy duty spools of the instant invention meet the demands for economical, lightweight and durable spools, they can be either disassembled and shipped for reuse, burned or shredded into pulp for use as recyclable paper following their use.

Accordingly, it can now be appreciated by those versed in this art that the present invention provides a solution, for example, to the disposable diaper industry that has sought to overcome the shortcomings associated with wood spools.

The above features and advantages of the present invention will be better understood with reference to the FIGS., Detailed Description and Example set out hereinbelow. It will also be understood that the spools of this invention are exemplary only and are not to be regarded as limitations of this invention.

DESCRIPTION OF THE FIGS.

Referenced is now made to the accompanying FIGS. in which are shown illustrative embodiments of the instant invention from which its novel features and advantages will be apparent:

DETAILED DESCRIPTION OF THE INVENTION

Figure 1:
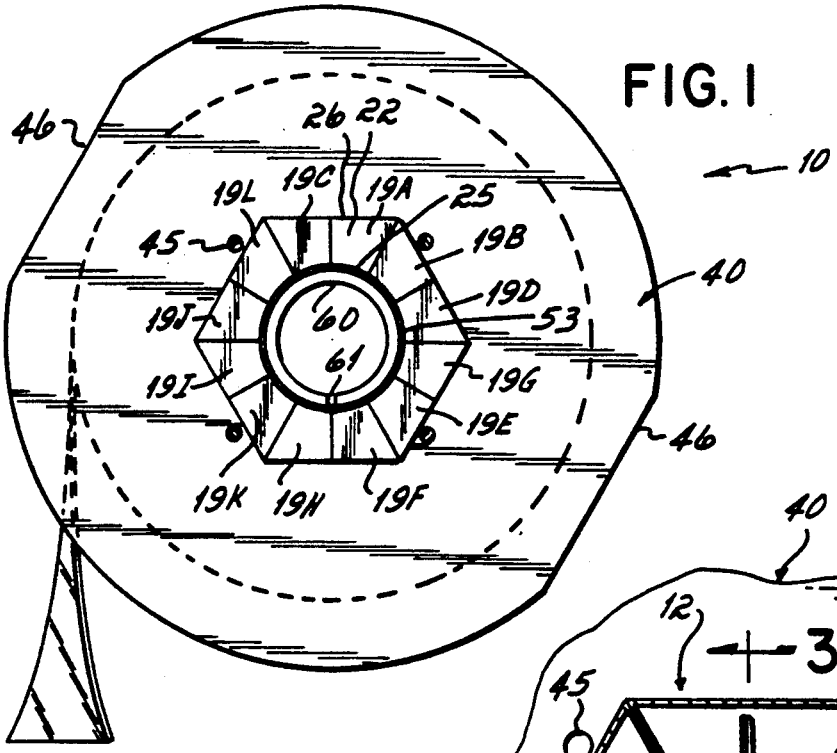
FIG. 1 is an end view of an assembled spool of the instant invention.
Figure 8:
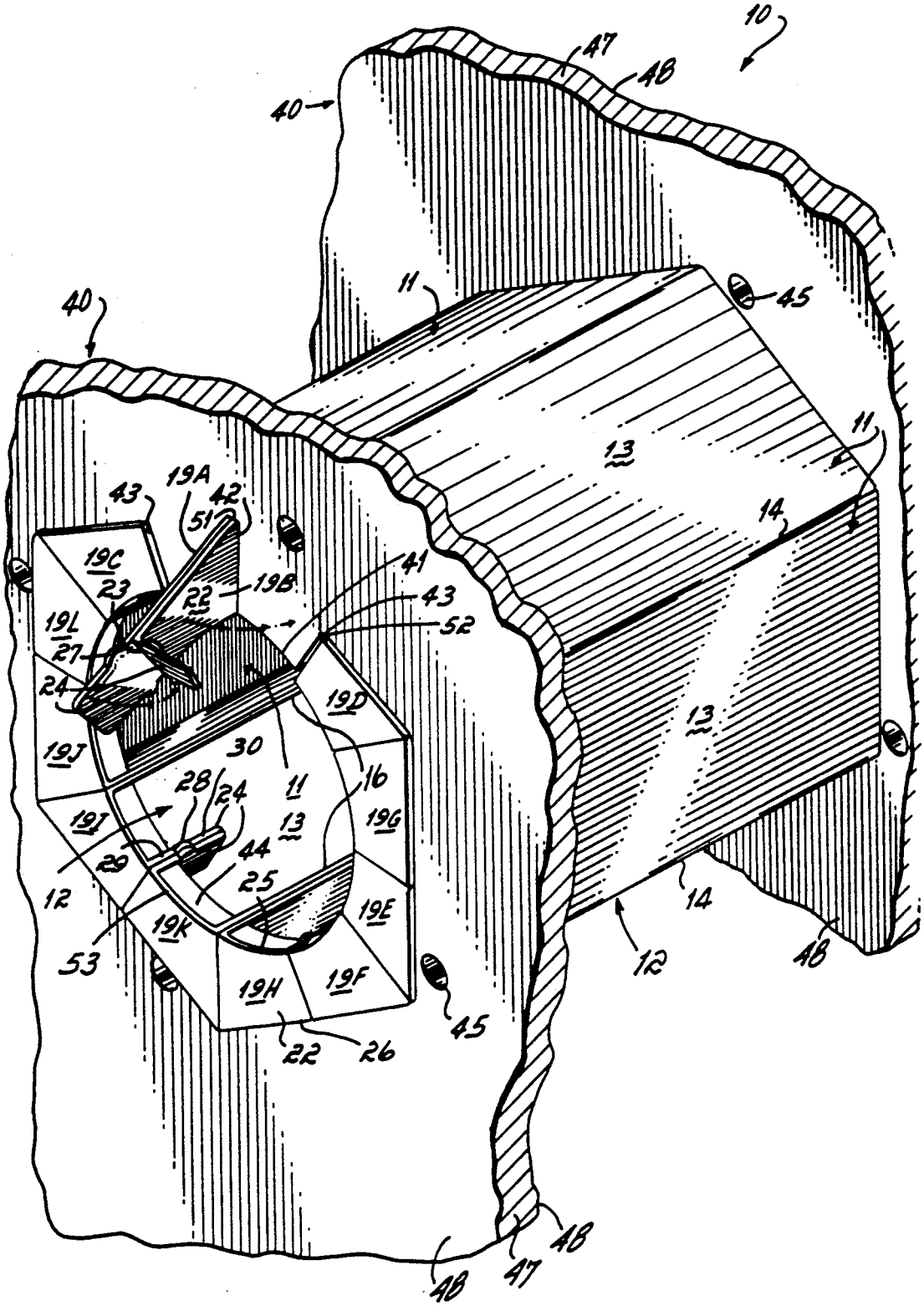
FIG. 8 is a partial perspective view of a partially assembled spool of the instant invention.

Referring now to the FIGS., wherein like or corresponding reference numerals are used to designate like or corresponding parts throughout the several views, there is shown in FIGS. 1 and 8 an assembled heavy duty spool or reel generally designated as 10, which is made substantially entirely of paperboard. Nevertheless, it should be appreciated that the heavy duty spools of the instant invention may be fabricated from other suitable lightweight materials, such as engineering plastics, so long as the objectives of the instant invention are not defeated.

Figure 2:
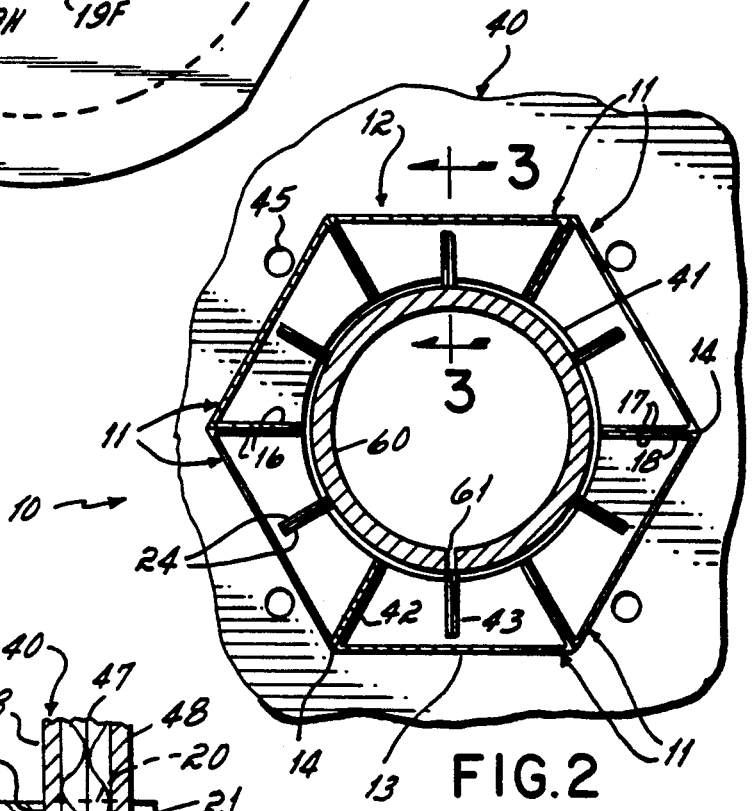
FIG. 2 is an enlarged cross-sectional view of the interior of the spool of FIG. 1.
Figure 3:
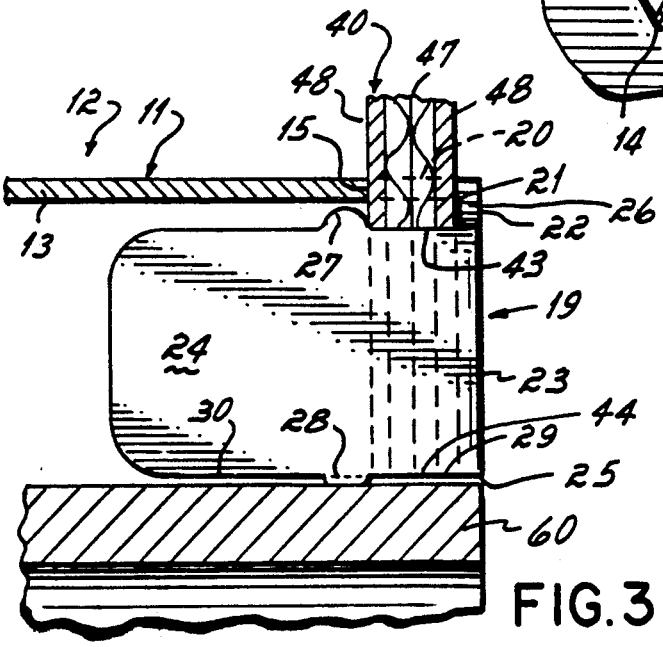
FIG. 3 is a view taken along lines 3—3 of FIG. 2.

Spool 10 comprises a longitudinally extending hollow outer core 12 and a pair of flange plates 40. Hollow outer core 12 is formed with a plurality of interlocks 11 which are of substantially identical construction. Interlocks 11 are disclosed specifically, in preferred form, in FIGS. 4 and 7, and are formed from initially flat cut and scored (folded lines) blanks of corrugated paperboard. The flange plates 40 are preferably of generally round configuration and also are of substantially identical construction. Flange plates 40 are disclosed specifically, in preferred form, in FIGS. 1, 5 and 6. Spool 10 further includes within hollow outer core 12 a generally longitudinally extending hollow inner core 60, as illustrated in FIGS. 1-3.

Figure 4:
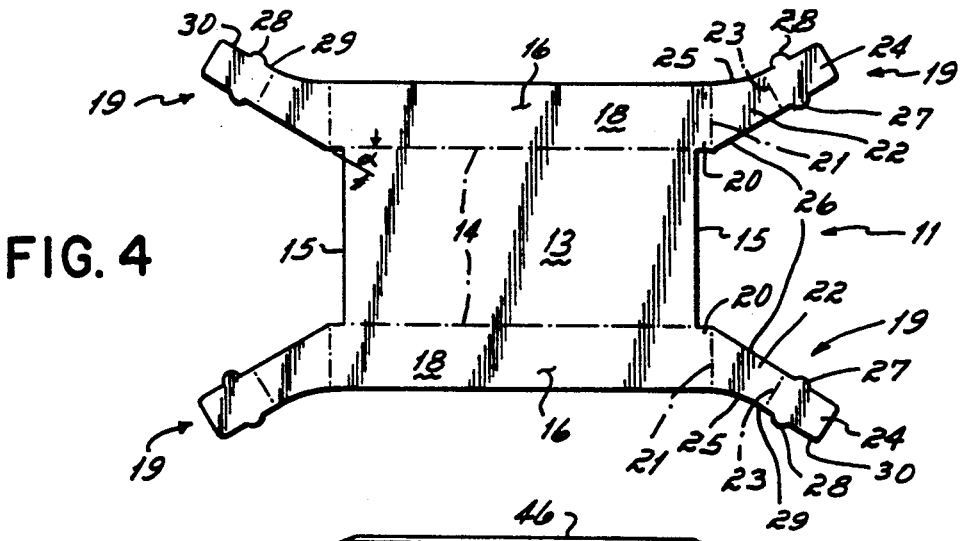
FIG. 4 is an unfolded plan view of one of the interlocks of the spool of FIG. 1.
Figure 7:
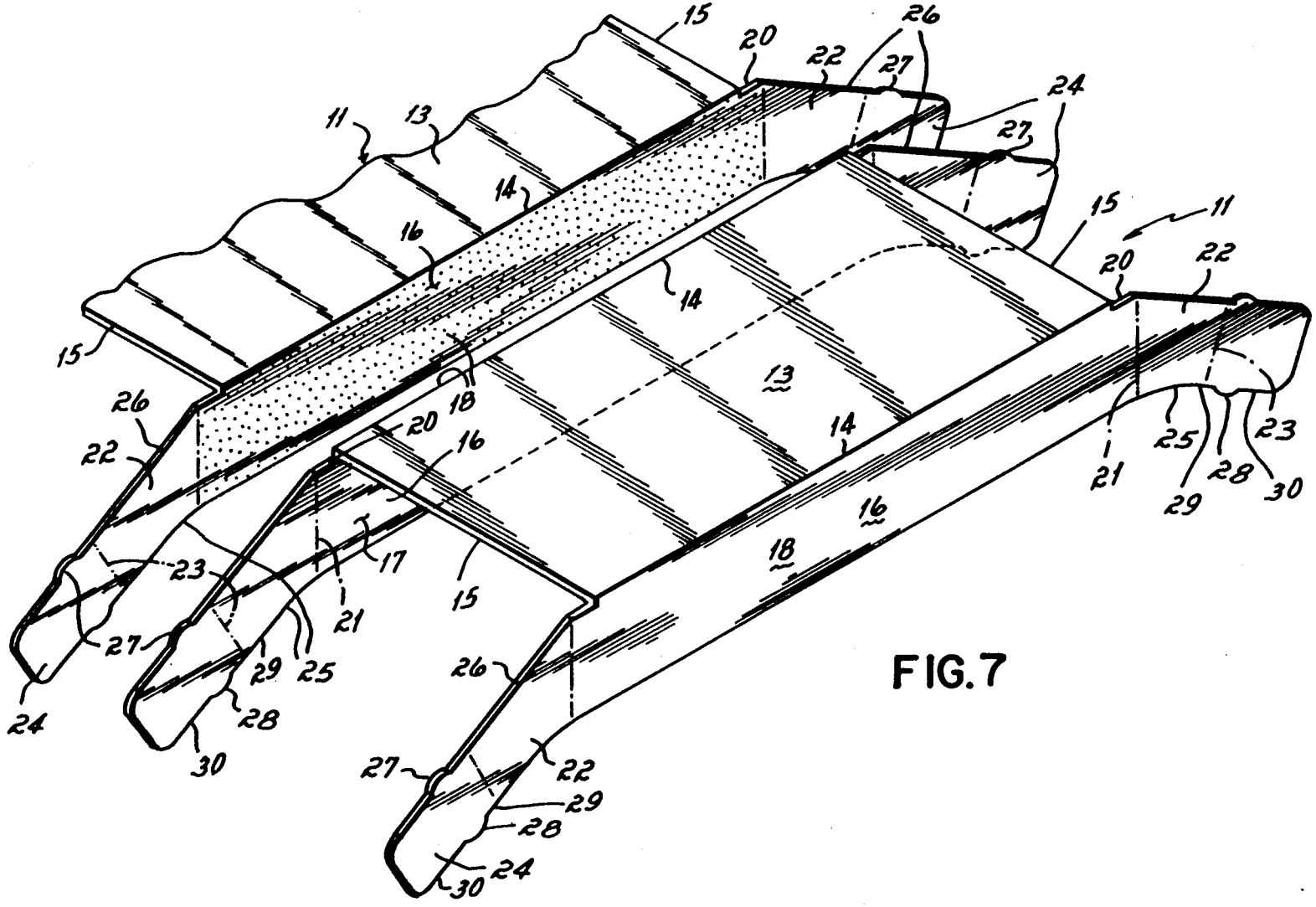
FIG. 7 is a partially folded perspective view of an interlock and a portion of another interlock of the type shown in FIG. 4.

Turning now to FIGS. 4 and 7, there is shown an interlock 11 in a preferred form prior to assembly as contemplated by the instant invention. More particularly, interlock 11 comprises a center panel 13 defined by side fold lines 14 and ends 15. Separated from center panel 13 by side fold lines 14 are foldably connected side panels 16 having interior and exterior faces 17 and 18, respectively, and side edges 29, as illustrated in FIGS. 4 and 7. Center panel 13 is somewhat shorter and wider than side panels 16, so that each of the side panels 16 have at their opposite ends a locking arm 19. Center panel 13 may, for instance, have a dimensional length between ends 15 from about 8" to about 14¼", and a dimensional width between side fold lines 14 of about, for example, 5⅝". While it is preferable to form hollow outer core 12 with six interlocks 11, and more preferable to form hollow outer core 12 with three pairs of two interlocks 11 connected to one another at exterior faces 18 of side panels 16 via any suitable adhesive, such as a biodegradable water soluble adhesive, as shown in FIG. 7, any suitable number or pairs of interlocks 11 having appropriate dimensions may be employed. It is believed that when the interlocks 11 of the instant invention are formed into pairs as described herein, additional strength is imparted to the formed hollow outer core 12.

Each locking arm 19 generally includes three sections, namely, a length 20, an integral flap 22 and a holding tab 24, as depicted in FIGS. 4 and 7. Each length 20 continues from a side panel 16 and generally extends beyond center panel 13 for a selected dimensional length which is preferably substantially equal to the thickness of flange plates 40. Each length 20 is defined by a first fold line 21 which separates the length 20 from an integral flap 22, and preferably has a dimensional width substantially equal to its corresponding side panel 16. Each integral flap 22 is foldably connected to a length 20 via the first fold line 21, and is defined by the first fold line 21 and a second fold line 23. Second fold line 23 separates integral flap 22 from a holding tab 24. Holding tabs 24 are generally rectangular in shape. Each integral flap 22 has a trapezoidal-like shape wherein the first and second fold lines 21 and 23, respectively, represent the two non-parallel sides, and outer and inner edges 25 and 26, respectively, represent the two somewhat parallel sides of the trapezoid. Outer edge 25 is arcuate-like in shape and preferably has a radius which is substantially equal to the radius of the center opening 41 of flange plates 40. Inner edge 26, on the other hand, is generally preferably straight in shape.

Because each integral flap 22 has a trapezoidal-like shape, with first fold line 21 constituting the larger of the two non-parallel sides and inner straight edge 26 constituting the larger of the two somewhat parallel sides of the trapezoid, each locking arm 19 tapers generally outwardly and away from center panel 13, as shown in FIG. 4. More particularly, each locking arm 19 extends outwardly and away from center panel 13 at a selected internal acute angle alpha of, for instance, substantially ±60°, which is formed by end 15 of center panel 13 and the plane along which inner straight edge 26 lies and meets center panel 13 at edge 15.

As indicated hereinbefore, a holding tab 24 is foldably connected to each integral flap 22 along second fold line 23. Extending outwardly and inwardly from holding tab 24 are locking tab 27 and friction tab 28, respectively. When hollow outer core 12 is formed from the interlocks 11 of the instant invention, each side panel 16 and each holding tab 24 form ribs which extend radially inwardly of the hollow outer core 12 for abutting hollow inner core 60, as shown in FIGS. 2 and 8. More particularly, each side edge 29 of each side panel 16 and each side edge 30 of each holding tab 24 form rib edges which abut the exterior surface of hollow inner core 60 so that hollow inner core 60 provides support to the hollow outer core 12 through the ribs. In addition, inwardly facing friction tabs 2 and the side edges 29 and 30 help to prevent inner core 60 from spinning independent of spool 10 during operation of the assembled spool 10, as developed in greater detail hereinafter.

Each interlock 11 is formed by, for example, die cutting preferably 275 lb. B flute corrugated paperboard against a hard pattern formed with, for example, steel which corresponds to a shape, such as depicted in FIG. 4 and described herein. While the flutes (not shown) of the corrugated paperboard may be parallel or perpendicular to side fold lines 14 of center panel 13, it is preferable to die cut the corrugated paperboard so that the flutes are arranged perpendicular to the side fold lines 14 for further enhancing the overall strength of each interlock 11 when assembled into hollow outer core 12, as depicted in FIG. 8.

Figure 5:
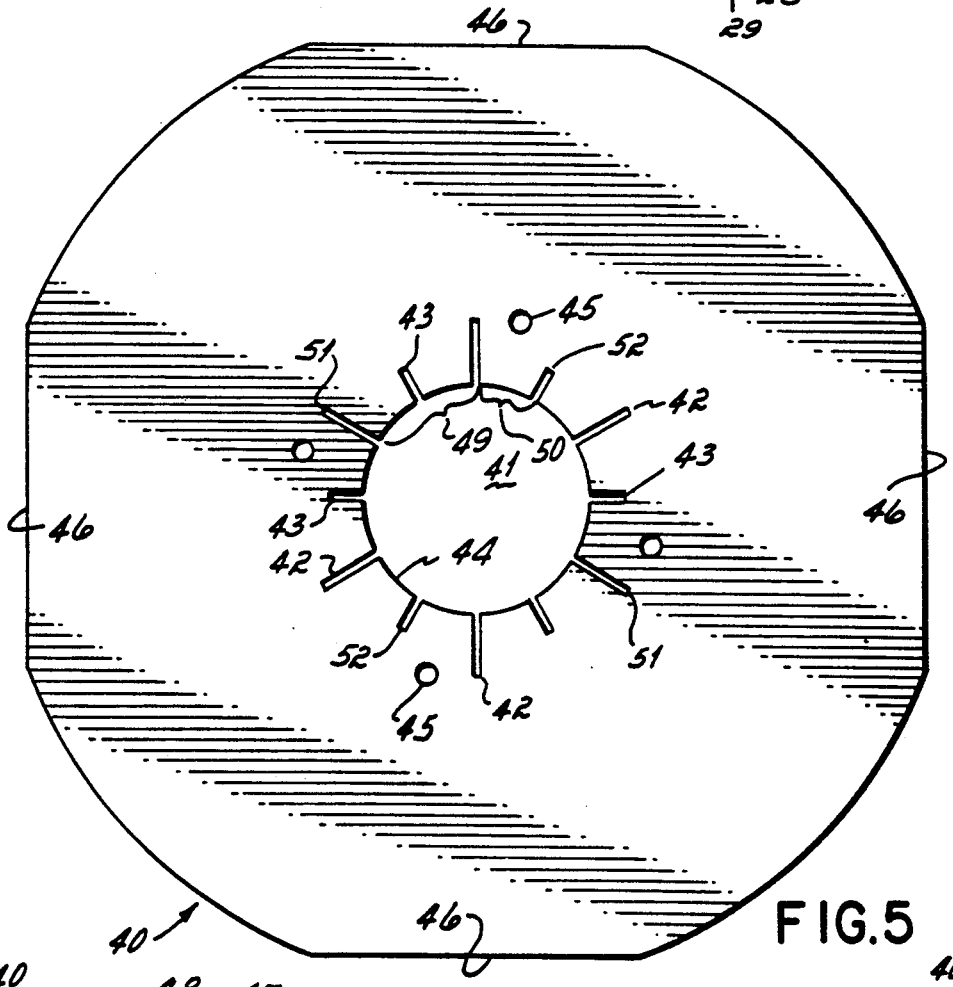
FIG. 5 is a plan view of one of the flange plates of the spool of FIG. 1.
Figure 6:
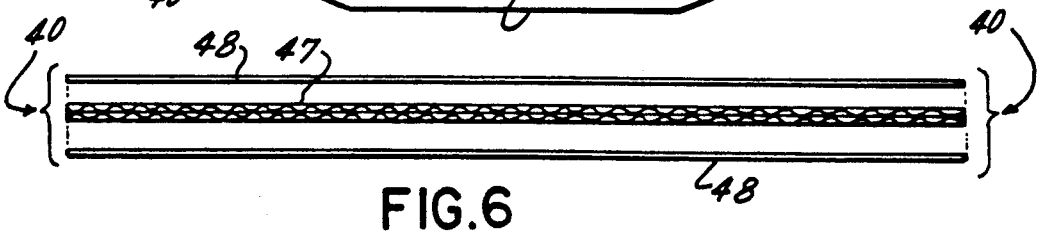
FIG. 6 is a dis-assembled cross-sectional view of a flange plate of the instant invention.

FIGS. 5 and 6 illustrate a flange plate 40 prior to assembly. Each flange plate 40 is generally circular or round in shape and is provided with a center opening 41. Center opening 41 may be of any convenient size which will snugly receive a hollow inner core or mandrel, such as hollow inner core 60. The flange plates 40 are provided with alternating long and short anchoring slots 42 and 43, respectively, which radially extend from the peripheral edge 44 of center opening 41 and are disposed in a selected spaced relation from one another. Each anchoring slot 42 and 43 preferably has a dimensional width which is substantially equal to the thickness of two interlocks 11. The spacing or distance between ends 51 of long positioning slots 42 should be substantially equal to the dimensional width of center panel 13 of interlock 11. As to the spacing or distance between each end 52 of each short positioning slot 43 and each end 51 of an adjacent long anchoring slot 42, it should substantially correspond to the dimensional parameters selected for the integral flap 22 of interlock 11. Each long anchoring slot 42 should have a dimensional radial length which is substantially equal to the width of length 20 of locking arm 19 of interlock 11 for receiving therein a corresponding length 20. The short anchoring slots 43 should have dimensional radial lengths which are substantially equal to the dimensional width of holding tabs 24 of locking arms 19 of interlocks 11 for receiving therein corresponding holding tabs 24. It should be appreciated that when the locking arms 19 are folded at the first and second fold lines 21 and 23, respectively, the integral flaps 22 and holding tabs 24 of locking arms 19 form L-shapes.

The flange plates 40 may be further provided with one or more viewing holes 45 which are disposed in spaced relation from one another and to the center opening 41. The viewing holes 45 should be of a sufficient size so that the product wound on core 12 of assembled spool 10 can be visually and continuously monitored during operation of the assembled spool 10, particularly as the product approaches the end, so that users will know when it is time to change the spool.

Optionally, each flange plate 40 may further include one or more flat regions 46 (two being shown at FIG. 1 and four being shown at FIG. 5) on its peripheral edge for stabilizing spool 10 when assembled. In other words, when assembled spool 10 is stored on the flat regions 46 of flange plates 40, the flat regions 46 prevent the assembled spool 10 from engaging in an uncontrolled and unassisted rolling motion. The flat regions 46 can be of any length, such as between 8 inches and 10 inches, which is effective for this purpose, and the flange plates 40 may include, for example, one to four or more flat regions 46.

While flange plates 40 can be formed with any suitable materials, flange plates 40 are preferably in laminate form having an inner layer 47 formed with double-ply corrugated paperboard and a pair of outer layers 48 formed with solid fiberboard, as shown in FIG. 6. More particularly, the inner layer 47 is preferably formed with one or more layers of, for example, 500 lb. BC double-walled corrugated paperboard or 350 lb. C single-walled corrugated paperboard wherein each double-walled or single-walled layer has a thickness of about 0.25 inches or 5/16 of an inch (double-walled) or about 0.125 inches or 3/16 of an inch (single-walled), respectively. When more than one double-walled corrugated paperboard layer is selected to form inner layer 47, it is preferable to laminate one double-walled corrugated paperboard layer in cross direction to the other such layer for enhancing the overall strength of same (not shown). The outer layers 48 are preferably formed with a fiber-board, namely, chipboard, each having a thickness of, for example, about 0.065 inches or 1/16 of an inch. Any suitable adhesive and preferably any suitable biodegradable water base adhesive commercially available may be employed to affix the inner layers 47 to one another and the outer layers 48 to the inner layer(s) 47 to form the laminate flange plate structures 40, as illustrated in FIG. 6.

As depicted in FIGS. 1-3, hollow inner core 60 is cylindrical in shape and should extend longitudinally for at least a distance which is substantially equal to the length of center panels 13 of interlocks 11 and the combined width of two flange plates 40. Moreover, hollow inner core 60 should have an outer diameter which substantially corresponds to the diameters of center openings 41 of flange plates 40 and to the internal diameter of the circular pattern 53 formed by the outer edges 25 of integral flaps 22 of interlocks 11 when they are assembled into hollow outer core 12, as shown in FIGS. 1, 2 and 8, so that hollow inner core 60 can be snugly received by center openings 41 and such circular pattern 53, as more clearly depicted in FIG. 2.

Typically, hollow inner core 60 may have a length of between about 9¼ and about 15¾ inches. While hollow inner core 60 can be formulated with any suitable materials, it is preferable to formulate hollow inner core 60 with solid paper wrap having a thickness of between about 0.450 and 0.5 inches with an average thickness of about 0.485 inches. In addition, hollow inner core 60 should be provided with at least one lengthwise slit 61 which extends preferably through one side of hollow inner core 60 for cooperating with friction tabs 28, side edges 30 of holding tabs 24 and side edges 29 of side panels 16 to help prevent hollow inner core 60 from rotating free of spool 10 once assembled. In other words, certain friction tabs 28 act as teeth along with side edges 29 and 30 to engage slit 61 of hollow inner core 60, as depicted in FIG. 2, to help lock hollow inner core 60 in place when hollow inner core 60 is expanded by an air bladder system (not shown) located on a rotatable shaft. Slit 61 further serves to facilitate a slight expansion in the diameter of hollow inner core 60, so that when hollow inner core 60 is inserted through central openings 41 and the hollow outer core 12, hollow inner core 60 firmly frictionally engages the inner surfaces of the central openings 41 and the side edges 29 and 30 to further prevent rotation of inner core 60 relative to flange plates 40 upon inflation of an air bladder system of the type mentioned hereinbefore.

To assemble an everyday spool 10 of the instant invention, three pairs of interlocks 11, wherein each pair is formed by bonding the two exterior faces 18 of two side panels 16 of two different interlocks 11 to one another via any suitable adhesive, and two flange plates 40 are utilized. It should be appreciated by those versed in this art that by forming interlocks 11 into pairs via bonding two side panels 16 to one another, the side panels 16 provide added strength to hollow out a core 12 to support the load of product received thereon. In assembling spool 10, adjacent locking arms 19A and 19B located in the middle of one pair of interlocks 11 are first inserted through a selected long anchoring slot 42 in one flange plate 40, as shown in FIG. 8. The non-adjacent locking arms 19C and 19D located on the respective ends of the pair of interlocks 11 are then inserted through respective long assembly slots 42 in a direction orientated away from hollow outer core 12, until ends 15 of central panels 13 are in an abutting relationship with the inner surface of outer layer 48 of flange plate 40, as shown in FIG. 8. At the first fold lines 21 of locking elements 19A and 19B, the locking arms 19A and 19B are folded away from another. At the second fold lines 23 of locking arms 19A and 19B, the locking arms 19A and 19B are again folded back toward flange plate 40 and hollow outer core 12, and the holding tabs 24 of the locking arms 19A and 19B are then inserted through a corresponding short anchoring slot 43, until the integral flaps 22 of locking arms 19A and 19B are in abutting relationships with the exterior surface of outer layer 48 of flange plate 40.

Now, at the first fold line 21 of locking arm 19C, locking arm 19C is folded toward locking arm 19A, as further shown in FIG. 8. At the second fold line 23 of locking arm 19C, locking arm 19C is folded back toward flange plate 40 and hollow outer core 12. Holding tab 24 of locking arm 19C is then inserted through the same short anchoring slot 43 as holding tab 24 of locking arm 19A until integral flap 22 of locking arm 19C is in an abutting relationship with the exterior surface of outer layer 48 of flange plate 40. Thus, locking arms 19A and 19C, which are hingedly connected to side panels 16 of the same interlock 11, share the same short anchoring slot 43.

Now, at the first fold line 21 of locking arm 19D, locking arm 19D is folded toward locking arm 19B, as further shown in FIG. 8. At the second fold line 23 of locking arm 19D, locking arm 19D is folded back toward flange plate 40 and hollow outer core 12. Holding tab 24 of locking arm 19D is then inserted through the same short anchoring slot 43 as holding tab 24 of locking arm 19B until integral flap 22 of locking arm 19D is in an abutting relationship with the exterior surface of outer layer 48 of flange plate 40. Thus, locking arms 19B and 19D, which are hingedly connected to side panels 16 of the same interlock 11, share the same short anchoring slot 43.

A second pair of interlocks 11 having locking arms 19E-19H is then connected to flange 40 following the same procedure as outlined above. It should be appreciated, however, that the adjacent locking arms designated as 19E and 19F located in the middle of the second pair of interlocks 11 are inserted through the next unused long anchoring slot 42, so that locking arm 19G of the second pair and locking arm 19D of the first pair share the same long anchoring slot 42 of flange plate 40, as shown in FIG. 8. Likewise, as to assembling the third pair of interlocks 11 having locking arms 19I-19L, the adjacent locking arms designated as 19I and 19J located in the middle of the third pair of interlocks 11 are inserted through the next unused long anchoring slot 42, so that locking arm 19K of the third pair and locking arm 19H of the second pair share the same long anchoring slot 42 of flange plate 40, and locking arm 19L of the third pair and locking arm 19C of the first pair of interlocks 11 share the same long anchoring slot 42 of flange plate 40, as shown in FIG. 8. This process is then repeated to connect the opposite ends of the three pairs of the interlocks 11 to the second flange plate 40 to complete the spool 10.

It should therefore be appreciated, that each short anchoring slot generally designated as 43 is shared by locking arms 19 hingedly connected to side panels 16 of the same interlocks 11, whereas each long anchoring slot generally designated as 42 is shared by locking arms 19 hingedly connected to side panels 16 of different interlocks 11. It should also be appreciated that when locking arms 19 are folded at the first and second fold lines 21 and 23, respectively, they form L-shapes with the integral flaps 22 lying flush against the exterior surfaces of outer layer 48 of flange plates 40 and holding tabs 24 lying perpendicular to integral flaps 22 and toward hollow inner core 12.

Once spool 10 is assembled, hollow inner core 60 may be inserted through the circular pattern 53 formed by the integral flaps 22 of locking arms 19 of the three pairs of interlocks of hollow outer core 12 and center opening 41 in one flange plate 40 until it lies flush with both outer layers 48 of each flange plate 40, as illustrated in FIGS. 1 and 2.

A spool in accordance with the instant invention will now be further illustrated in connection with the following Example.

EXAMPLE

In one embodiment of a spool 10 illustrated in the FIGS. hereof, the preferable dimensions for an interlock 11 are as follows. Center panel 13 has a dimensional length between ends 15 of about 11 inches and a dimensional width between side fold lines 14 of about 5⅝ inches. Each side panel 16 has a dimensional length which corresponds to the dimensional length of center panel 13, i.e., about 11 inches, and a dimensional width of about 2 inches. Each length 20 has a dimensional length of about 0.4375 inches, which is substantially equal to the thickness of flange plate 40. Side fold lines 14, first fold lines 21 and second fold lines 23 have widths of about ⅛ of an inch. Inner edge 26 of flap 22 is generally straight and has a dimensional length between first and second fold lines 21 and 23, respectively, of about 2 inches. The arc defined by inner edge 25 and subtended by first and second fold lines 21 and 23, respectively, is about 26° at a radius of about 3.5 inches and has an arc length of about 1.58 inches. Holding tabs 24 are generally rectangular in shape and have dimensional lengths of about 2 inches and dimensional widths of about 1⅜ inches. Since the blanks from which the interlocks 11 are formed are preferably formed with 275 lb. B flute corrugated paperboard, the blanks and interlocks 11 have thicknesses of about 0.125 inches.

Each flange plate 40 has a radius of about 38¼ inches and is provided with two flat regions 46 being oppositely opposed to one another and each having dimensional lengths of about 10 inches. The central openings 41 have diameters of about 7 inches and radiuses of about 3.5 inches for receiving the hollow inner core 60, as depicted in FIGS. 2 and 5. Hollow inner core 60 has an outer diameter of about 7 inches, an average thickness of about 0.485 inches, and a length of about 12.25 inches.

Each flange plate 40 is further provided with a total of twelve alternating assembling slots wherein six are long assembling slots 42 and six are short assembling slots 43. Each of the twelve assembling slots have a width of about 0.25 inches, which is substantially equal to the thickness of two interlocks 11. The long assembling slots 42 each have a dimensional length radially extending from center opening 41 of approximately 2 inches, which correspond to the dimensional width of lengths 20 of locking arms 19 of interlocks 11 and for receiving the lengths 20 of end panels 18 therein. The spacing between ends 51 of long assembling slots 42 is about 5⅝ inches, which substantially corresponds to the dimensional width of center panels 13, whereas the length of each long arc 49 subtended between long assembling slots 42, as illustrated in FIG. 5, is about 3.3 inches. Long arc 49 is also about 56° at about a 3.5 inch radius. The short assembling slots 43 each have a dimensional length radially extending from center opening 41 of approximately 1⅜ inches, which corresponds to the dimensional width of holding tab 24 for receiving therein holding tab 24. The length of each small arc 50 subtended by adjacent short and long assembling slots 43 and 42, respectively, is about 1.58 inches, as depicted in FIG. 5. Also, each small arc 50 is about 26° at a radius of 3.5 inches, which substantially corresponds to the arcs defined by outer edges 25 of integral flaps 22 of interlocks 11. Thus, when hollow outer core 12 is formed, the internal diameter of circular patterns 53 formed by the outer edges 25 of the integral flaps 22 of locking arms 19 are about 7 inches, which corresponds to the diameter of center openings 41 in flange plates 40 and the outer diameter of hollow inner core 60.

Hollow outer core 12 is formed with a total of six interlocks 11, of which there are three pairs. The pairs of interlocks 11 are formed by affixing exterior faces 18 of two side panels 16 of different interlocks 11 to one another via any preferable conventional biodegradable water soluble adhesive, as shown in FIG. 7. The interlocks are die cut from 275 lb. B flute corrugated paperboard and have thicknesses of about 0.125 inches. The 275 lb. B flute corrugated paperboard may be obtained from Trey Corrugated, Inc., 11301 Jefferson Avenue, Sharonville, Ohio 45041. Flange plates 40 are in the form of laminate structures which include an inner layer 47 of 500 lb. BC double-walled corrugated paperboard laminated between outer layers 48 of solid 0.065 inch chipboard. The 500 lb. BC double-walled corrugated paperboard may be likewise obtained from Trey Corrugated, Inc. whereas the solid 0.065 inch chipboard may be obtained from Franklin Box Board, 50 East 6th Street, Franklin, Ohio 45005. The outer chipboard layers 48 are attached to the inner corrugated paperboard layer 47 via commercially available biodegradable water soluble adhesive No. 789, Beaver Adhesive, Edgewin Avenue, Hillard, Ohio 43026. Flange plates 40 have a practicable thickness of about 0.4375 inches. Hollow inner core 60 is formed with solid paper wrap and has a through-slit 61 which extends along the entire longitudinal length of one side thereof. Hollow inner core 60 can be obtained from Sunoco Products Company, P.0. Box 338, Akron, Ind. 46910 and referenced as Spiral Wound Tube, 6 inch diameter, 0.5 inch wall.

When assembled, this spool 10 weighs about 8.75 lbs. and has the capacity to hold between about 375 lbs. and about 675 lbs or more of unfilled plastic or paper bags, such as between about 2,800 and about 3,000 or more unfilled plastic or paper bags which are sized to hold disposable diapers. It should be appreciated by those skilled in this art that while the spools of the present invention have been preferably described herein in connection with unfilled plastic or paper bags which are sized to hold disposable diapers, they are nevertheless suitable to hold other products, such as hose, cables, wires, rope and pieces of extruded plastic or the like, which are typically wound upon spools for storing and/or shipping.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced herein.

Having described my invention, I claim:

1. A heavy duty spool suitable for receiving a product, such as at least about 375 lbs. of product or at least about 2,800 unfilled plastic or paper bags sized to hold disposable diapers, said spool comprises:

a pair of flange plates having respective inner and outer surfaces, said flange plates being connected to one another in a mutually parallel spaced relationship by a hollow outer core bridging said inner surfaces of said plates along an axis perpendicular to each of said plates, each said flange plate having a central opening and a plurality of alternating long and short anchoring slots intersecting said central opening and extending radially outwardly therefrom;

said hollow outer core including a plurality of interlocks, each said interlock comprising three panels including a center panel and a pair of end panels, each said end panel being hinged to said center panel about a side fold line orientated parallel to said axis and including a locking arm extending from each end of each said end panel, each said locking arm being hinged to one said end of each said end panel about a first fold line orientated transverse to said axis, each said locking arm including a second fold line orientated transverse to said axis to form an L-shape, each said L-shaped locking arm including an integral flap lying between said first and second fold lines and a holding tab hinged to said integral flap along said second fold line;

each said long anchoring slot having two said locking arms of different ones of said interlocks inserted therethrough in a direction orientated away from said hollow outer core, each said short anchoring slot having two holding tabs of a same one of said interlocks inserted therethrough in a direction orientated toward said hollow outer core, each said locking arm of each said same interlock being folded at the said first fold line toward one another, said holding tabs of each same said interlock being folded at said second fold lines and inserted through one of said short anchoring slots in a direction orientated toward said hollow outer core, said integral flaps lying adjacent said outer surfaces of said flange plates; and a hollow inner core having an exterior surface, said hollow inner core being received within said hollow outer core and said central openings, said end panels and said holding tabs forming ribs extending radially inwardly of said hollow outer core for leading support to said hollow outer core, each of said ribs having a rib edge which abuts the exterior surface of said hollow inner core so that said hollow inner core lends support to said hollow outer core through said ribs.

2. A heavy duty spool of claim 1, said spool being fabricated from paperboard.

3. A heavy duty spool of claim 1, said spool including at least one viewing hole in at least one said flange plate, said viewing holes being of a size sufficient to permit product wound on said hollow outer core to be viewed.

4. A heavy duty spool of claim 1, said spool including at least one flat region on each said flange plate to help prevent said spool from rolling.

5. A spool suitable for receiving product, said spool comprises:

a pair of flange plates having respective inner and outer surfaces, said flange plates being connected to one another in a mutually parallel spaced relationship by a hollow outer core bridging said inner surfaces of said plates along an axis perpendicular to each of said plates, each said flange plate having a central opening and a plurality of alternating long and short anchoring slots intersecting said central opening and extending radially outwardly therefrom, said hollow outer core having a plurality of locking arms engaging said slots to lock said hollow outer core to each of said flange plates.

6. A spool of claim 5, said hollow outer core having a plurality of ribs extending radially inwardly of said hollow core to lend support to same.

7. A spool of claim 6, said spool further including a hollow inner core received within said hollow outer core and said central openings, said ribs abutting said hollow inner core so that said hollow inner core lends additional support to said hollow outer core through said ribs.

8. A spool of claim 5, said spool having at least one viewing hole in at least one flange plate, said viewing hole being of a size sufficient to permit product wound on said hollow outer core to be viewed.

9. A spool of claim 5, said spool including at least one flat region on each said flange plate to help prevent said spool from rolling.

10. A spool of claim 5, said spool being fabricated from a paperboard material.

11. A spool comprising:

a pair of flange plates having respective inner and outer surfaces, each said flange plate having a central opening and a plurality of alternating long and short anchoring slots intersecting said central opening and extending radially outwardly therefrom;

a hollow outer core bridging said inner surfaces of said flange plates to one another in a mutually parallel spread relationship along an axis perpendicular to each said flange plate, said hollow core including a plurality of interlocks, each said interlock comprising three panels including a center panel and a pair of end panels, each said end panel being hinged to said center panel about a side fold line orientated parallel to said axis and including a locking arm extending from each end of each said end panel, each said locking arm being hinged to one said end of each said end panel about a first fold line orientated transverse to said axis, each said locking arm including a second fold line, each said locking arm including an integral flap lying between said first and second fold lines and a holding tab hinged to said integral flap along said second fold line such that said first and second fold lines are orientated transverse to said axis and each said locking arm forms an L-shape;

whereby each said long anchoring slot having two said locking arms of different ones of said interlocks inserted therethrough in a direction orientated away from said hollow outer core, each said short anchoring slot having two holding tabs of a same one of said interlocks inserted therethrough in a direction orientated toward said hollow outer core, each said locking arm of each said same interlock being folded at the said first fold line toward one another, said holding tabs of each same said interlock being folded at said second fold lines and inserted through one of said short anchoring slots in a direction orientated toward said hollow outer core, said integral flaps lie adjacent said outer surfaces of said flange plates, and said end panels and said holding tabs forming ribs extending radially inwardly of said hollow outer core for, lending support to said hollow outer core.

12. A spool of claim 11, said spool further including hollow inner core having an exterior surface, said hollow inner core being received within said hollow outer core and said central openings, each of said ribs having a rib edge which abuts the exterior surface of said hollow inner core so that said hollow inner core lends support to said hollow outer core through said ribs.

13. A spool of claim 11, said flange plates and hollow outer core being fabricated from paperboard.

14. A spool of claim 11, wherein at least one said flange plate includes a viewing hole, said viewing hole being of a size sufficient to permit product wound on said hollow outer core to be viewed.

15. A spool of claim 11, each said flange plate including at least one flat region thereon to help prevent said spool from rolling.

* * * * *